US008869868B1

(12) United States Patent
Schmidt

(10) Patent No.: US 8,869,868 B1
(45) Date of Patent: Oct. 28, 2014

(54) DOOR SEALING MECHANISM

(76) Inventor: David L. Schmidt, Zimmerman, MN (US)

( * ) Notice: Subject to any disclaimer, the term of this patent is extended or adjusted under 35 U.S.C. 154(b) by 0 days.

(21) Appl. No.: 13/424,350

(22) Filed: Mar. 19, 2012

(51) Int. Cl.
*E05D 15/26* (2006.01)
*E05D 15/00* (2006.01)

(52) U.S. Cl.
USPC ..... 160/209; 160/201; 16/DIG. 1

(58) Field of Classification Search
USPC ..... 160/201, 209; 248/295.11; 49/197, 209; 16/106, 109, 90, 91, 96 R, DIG. 1, 98, 16/99
See application file for complete search history.

(56) References Cited

U.S. PATENT DOCUMENTS 988,880 A * 4/1911 Klotz ..... 16/91
1,985,976 A * 1/1935 Clark ..... 160/209
2,827,114 A * 3/1958 Stroup ..... 160/209
3,024,838 A 3/1962 Egleston et al.
3,853,420 A * 12/1974 Abell ..... 408/14
4,120,072 A * 10/1978 Hormann ..... 16/87 R
4,251,043 A * 2/1981 Horner ..... 248/117.6
4,800,618 A * 1/1989 Putz ..... 16/95 R
4,957,301 A 9/1990 Clay et al.
6,928,696 B2 * 8/2005 Wartman ..... 16/99
7,029,041 B2 4/2006 Keller
7,784,520 B2 * 8/2010 Paulson ..... 160/201

* cited by examiner

*Primary Examiner* — Katherine Mitchell
*Assistant Examiner* — Jeremy Ramsey
(74) *Attorney, Agent, or Firm* — Richard John Bartz

(57) ABSTRACT

A sealing mechanism for retaining a roll-up garage door in surface sealing engagement with adjacent door jambs to prevent air leakage around the roll-up door has brackets secured to opposite sides of the roll-up door cooperating with roller holders attached to the door jambs to hold the roll-up door when in its closed position in surface sealing engagement with the door jambs.

14 Claims, 18 Drawing Sheets

DOOR SEALING MECHANISM

CROSS REFERENCE TO RELATED APPLICATION

None.

FIELD OF THE INVENTION

The invention relates to a mechanism for holding a door tight against a door frame to inhibit air leaks around the door and to prevent oscillations of the door relative to the door jamb. More specifically, the invention is a door sealing mechanism used with a conventional roll-up garage door to retain the garage door in firm surface sealing engagement with the door jambs located around the garage door.

BACKGROUND OF THE INVENTION

Conventional roll-up garage doors have a plurality of panels articularly connected with hinges. The door is movable along rails between closed and open positions. The rails mounted on upright frames or door jambs accommodate rollers located on axles joined to the hinges. The rails and rollers retain the door in its closed position adjacent the door jambs. Repeated opening and closing of the door over time moves the track and rollers to positions away from the door jambs creating a space that allows air, dust, water and snow to leak around the door into the enclosed room or garage. Also, warm air in the garage flows out through the space between the door and door jambs to the exterior atmosphere resulting in a loss of heat energy. When the closed door is subjected to air currents due to wind, the door laterally moves relative to the door jambs and rails causing door vibrations and noise. These conditions can be overcome by adjusting the positions of the tracks, the weather stripping or the door jambs. The adjustments are labor intensive, time consuming and expensive.

A seal member for closing the space between a roll-up door and a door frame is disclosed by R. T. Clay and D. J. Whiting, Jr. in U.S. Pat. No. 4,957,301. The seal member includes a first position mounted on the frame and a second portion biased to flexibly engage the outer surface of a panel of the roll-up door. The first position of the seal member contacts a stop on the panel of the door to prevent the second portion of the seal member from becoming crushed against the first portion of the seal member to protect the second portion from damage and allow substantially free vertical movement of the roll-up door.

Latch mechanisms for sealing a door tight to a door frame are disclosed by R. D. Keller in U.S. Pat. No. 7,029,041. This mechanism has a latch arm pivotally secured to a panel of the door and a latch member secured to the door frame in which the door is mounted. The latch arm and member are arranged and constructed so that when the door is in the closed position, the latch arm engages the latch member. The latch arm is then pivoted to a position that exerts force on the latch member to cause the door to contact the door frame thereby retaining the door tight against the door frame.

The objectives and advantages of the door sealing mechanism are incorporated in the following description in conjunction with the accompanying drawing wherein like reference numbers refer to the same or similar parts throughout the several views of the drawing.

SUMMARY OF THE INVENTION

The door sealing mechanisms are combined with a conventional roll-up garage door for retaining the door in surface sealing engagement with adjacent door jambs to prevent air leakage around the door to outside atmosphere and the flow of outside air into the garage. The door sealing mechanisms also prevent lateral movements or oscillations of the door relative to the door jambs and tracks thereby eliminating objectionable noise. Each door sealing mechanism has a first member attached to a door panel of a roll-up door and a second member mounted on the door jamb or frame adjacent the first member. The first and second members have cooperating structures that engage each other when the door is in the closed position to retain the door in surface sealing engagement with adjacent door jambs to inhibit air leakage around the door to outside atmospheric and outside air into the garage or interior space adjacent the door. The cooperating structures disengage each other when the door is moved between the closed position to the open position. The first member is a bracket attached to the door in a selected location. The bracket has a top surface which can be convex, flat or inclined. The second member is a holder having a post attached to a door jamb adjacent the bracket. An arm mounted on post supports a roller or lip that engages the top surface of the bracket when the door is closed to retain the door in surface sealing engagement with the adjacent door jamb. The arm is adjustable along the length of the post whereby the holder may be used with different size brackets located in different positions on the door. The bracket can be secured to a door jamb in selected locations. The second member including the post, arm and roller or lip can be attached to the door panel adjacent the bracket secured to the door jamb.

DESCRIPTION OF THE INVENTION

Figure 1:
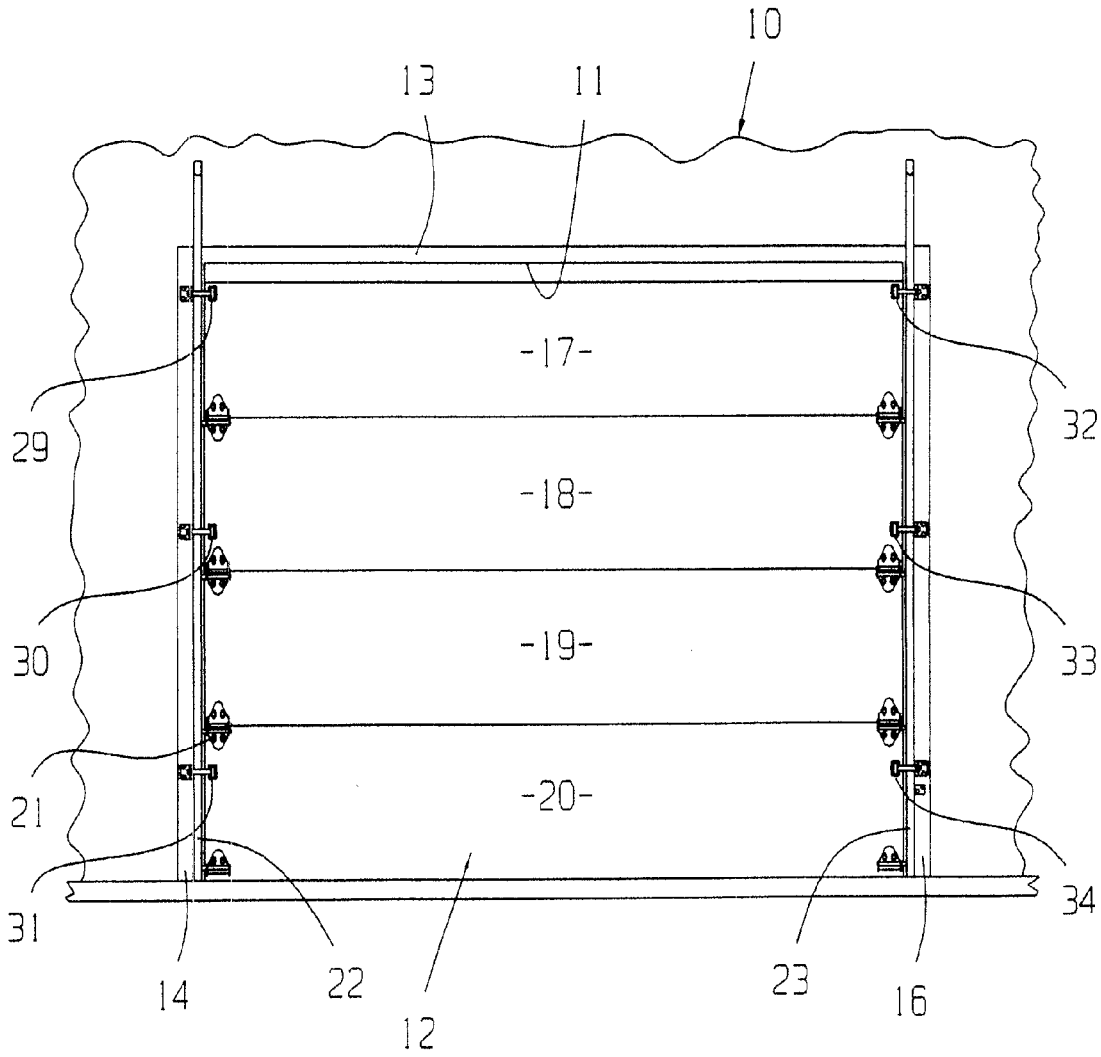
FIG. 1 is an elevational view of the inside of a roll-up garage door equipped with door sealing mechanisms for holding the door closed against a door jamb of the invention.
Figure 2:
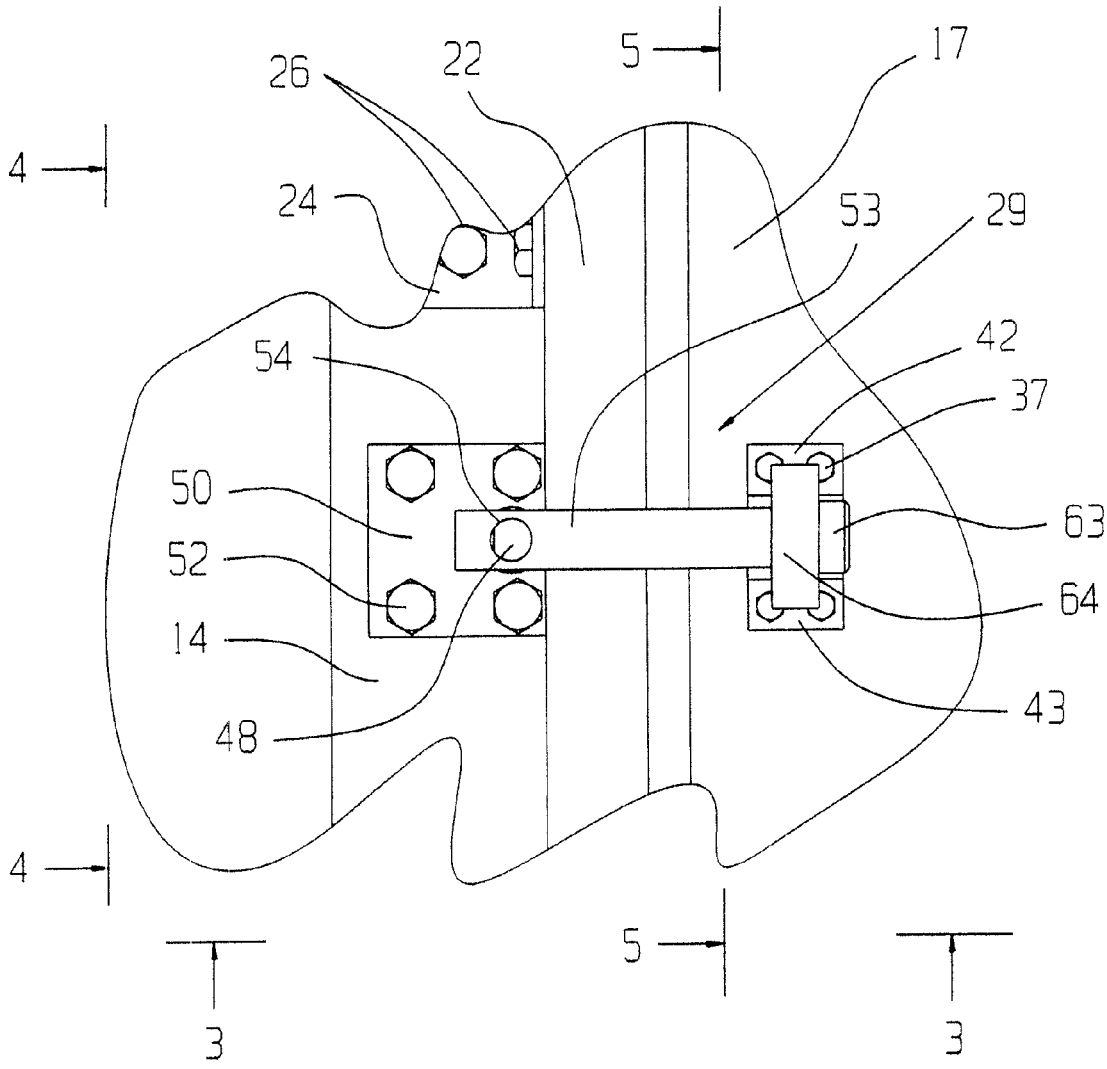
FIG. 2 is an enlarged elevational view of a first embodiment of a door sealing mechanism of FIG. 1.
Figure 3:
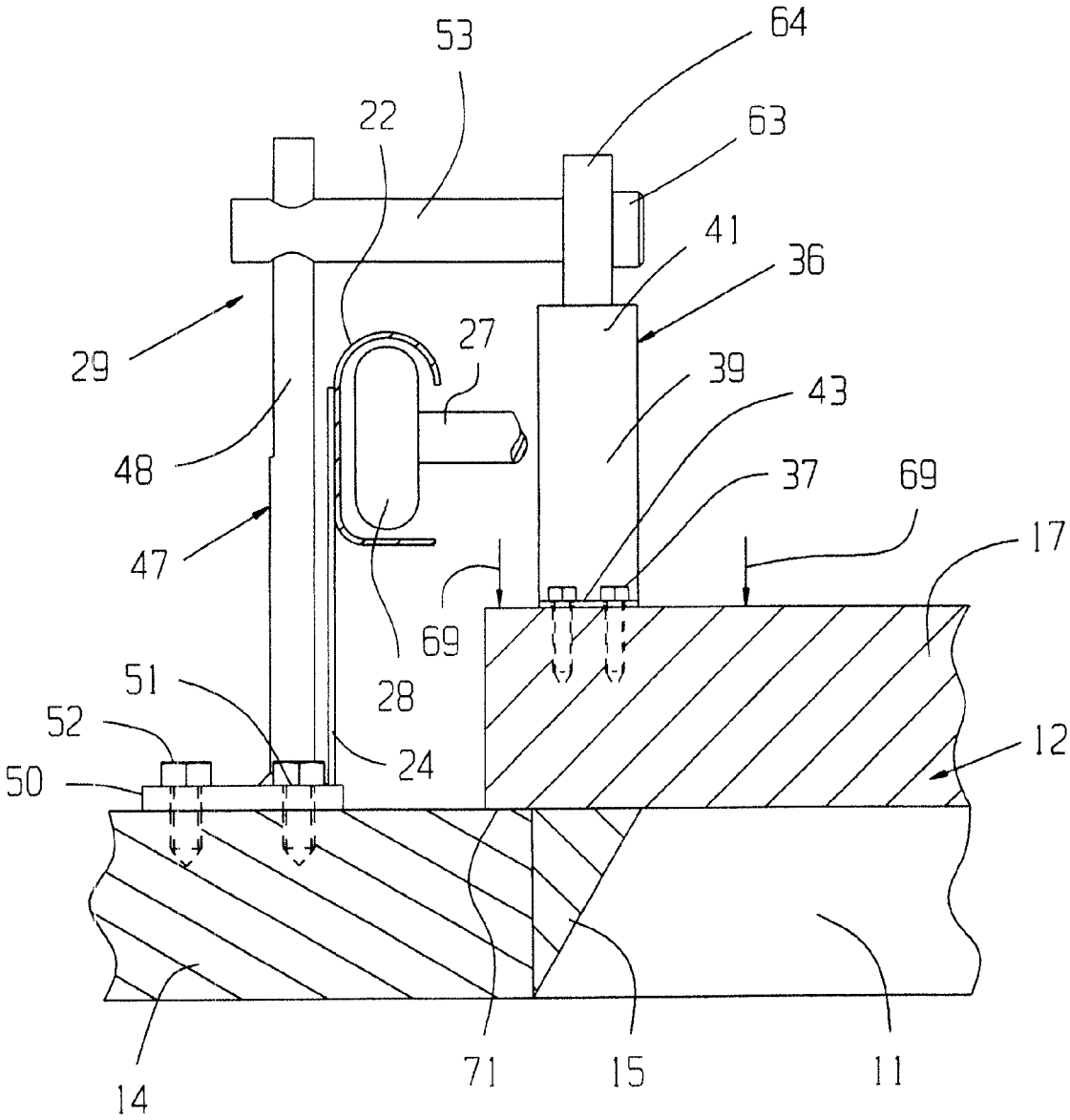
FIG. 3 is a sectional view taken along the line 3-3 of FIG. 2.

As shown in FIG. 1, a building, such as a garage, has an upright wall 10 with a doorway 11 closed with a conventional roll-up door 12. Wall 10 has a horizontal header 13 extended between left and right side frames or jambs 14 and 16 providing doorway 11 or opening into the building. A flexible seal 15 secured to jambs 14 and 16 contacts the outside surface of door 12. Roll-up door 12 has a plurality of rectangular panels 17, 18, 19 and 20 pivotally connected with hinges 21. Panels 17-20 can be solid wood or metal members. One or more of the panels can include one or more windows. Roll-up door 12 is a typical overhead garage door that moves along tracks 22 and 23 between open and closed positions. As shown in FIG. 3, track 22 is a C-shaped channel member having an upright section located generally parallel to side jamb 14. A plurality of L-shaped brackets 24 connect track 22 to side jamb 14. Fasteners 26, such as bolts and screws, secure bracket 24 to track 22 and jamb 14. Hinges 21 have lateral axles or rods 27 rotatably supporting rollers 28 that ride on track 22 as shown in FIG. 3. Track 23 located on the door jamb 16 accommodates rollers associates with hinges as described with reference to track 22 and roller 28 as shown in FIG. 3. Rollers 28 associated with each of hinges 22 and 23 cooperate with tracks 22 and 23 to retain door 12 adjacent jambs 14 and 16 when door 12 is in the closed position. When door 12 is moved upward to the open position, rollers 28 riding on tracks 22 and 23 move door 12 up and away from jambs 14 and 16 to allow door 12 to freely move to an open position. Repeated opening and closing of door 12 with a conventional electric motor garage door opener (not shown) results in an air space between door 12 and jambs 14 and 16. This air space allows cold air, water, dust and snow to flow into the interior of the building as well as allowing heated air to escape to outside atmosphere. Tracks 22 and 23 and/or jambs 14 and 16 must be adjusted to minimize the space between door 12 and jambs 14 and 16. These adjustments are costly, time consuming and dangerous due to door springs.

Returning to FIG. 1, a plurality of door sealing mechanisms 29 to 34 located adjacent opposite sides of door 12 automatically relocates door 12 from an unrestrained open position to a position wherein opposite sides of door 12 are in surface sealing engagement with adjacent jambs 14 and 16. The door sealing mechanisms 29 to 34 operate in concert to eliminate air leaks around the side edges and top of door 12 when in the closed position. Door sealing mechanisms 29 to 34 also prevents lateral movements or oscillations of door 12 due to windy environment conditions. Door sealing mechanisms 29 to 34 conserve heat energy, saves money and eliminates noise due to door oscillations. The door sealing mechanisms 29 to 34 are substantially identical in structure and function. The following is a description of door sealing mechanism 29. The remaining door sealing mechanisms 30, 31, 32, 33 and 34 are substantially the same as door sealing mechanism 29 located in separate positions on opposite sides of door 12 to retain door 12 in surface sealing engagement with jambs 14 and 16 to prevent air leakage around the door.

Door sealing mechanism 29, shown in FIGS. 3 to 7, has a first member comprising an inverted U-shaped member or bracket 36 secured to door panel 17 with fasteners 37, such as screws. Other types of fasteners including but not limited to bolts and adhesives can be used to attach bracket 36 to door panel 20. Bracket 36 is a one-piece metal member having flat upright back or side sections 38 and 39 joined to a convex curved top section 41. The lower ends of side sections 38 and 39 are joined to outwardly projected feet or flanges 42 and 43 located in surface contact with door panel 17. Flanges 42 and 43 have holes 44 and 46 accommodating fasteners 37 that retain bracket 36 on door panel 17. Bracket 36 projects in a generally horizontal direction away from the inside surface of door panel 17. The horizontal lengths of the brackets associated with door sealing mechanisms 30 and 31 are shorter than the bracket of door sealing assembly 29. The bracket of door sealing mechanism 31 is the shortest bracket. The bracket of door sealing mechanism 30 is the mid-sized bracket. The tallest bracket is the bracket of door sealing mechanism 29.

Figure 7:
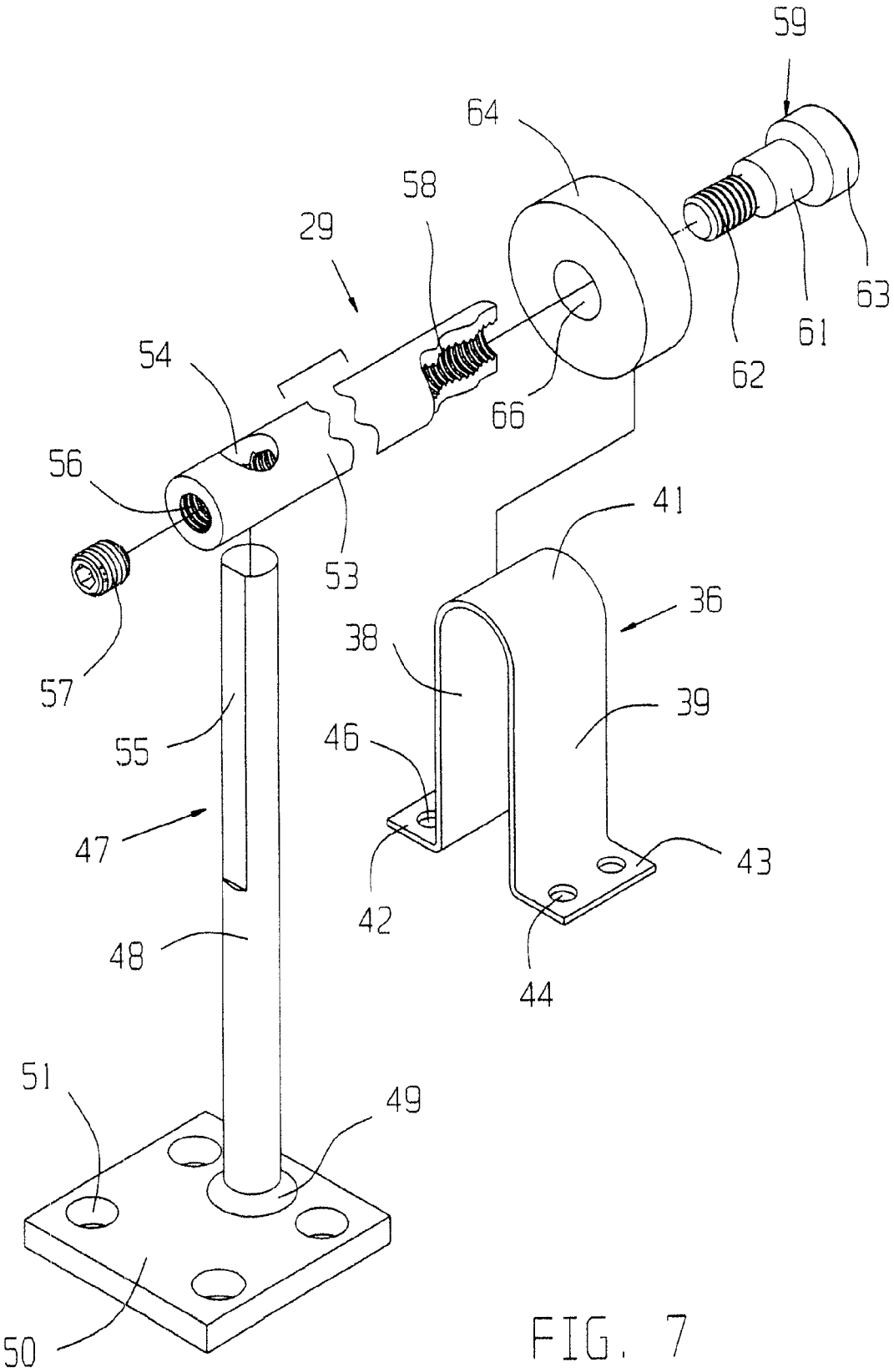
FIG. 7 is a foreshortened exploded perspective view of the door sealing mechanism of FIG. 6.

Door sealing mechanism 29 has a second member comprising a roller holder 47 having a generally horizontal cylindrical post 48 secured with a weld 49 to a flat base 50. A plurality of holes 51 in base 50 accommodate fasteners 52, such as screws, that secure base 50 to jamb 14. Other types of fasteners, such as bolts and adhesives, can be used to attach base 50 to jamb 14. Post 48 is parallel to bracket 36 and extends away from jamb 14. As shown in FIG. 7, an elongated arm 53 has a hole 54 in one end and a first threaded bore 56 open to hole 54. Post 48 extended through hole 54 is secured to arm 53 with a set screw 57 threaded into bore 56. Post 48 has a flat upright surface 55 located in hole 54 to prevent turning of arm 53 relative to post 48 and allowing adjustment of arm 53 along the length of post 48. Set screw 57 engages flat upright surface 55 to orient arm 53 on post 48 and allows the position of arm 53 on post 48 to be adjusted to accommodate different length brackets of the door sealing mechanisms 29 to 34. Arm 53 has a second threaded bore 58 accommodating a bolt 59. Bolt 59 has a cylindrical stem 61 joined to a threaded end 62 and a head 63. A cylindrical roller 64 has a cylindrical bore 66 rotatably located on stem 61. Roller 64 is free to rotate on stem 61.

Figure 4:
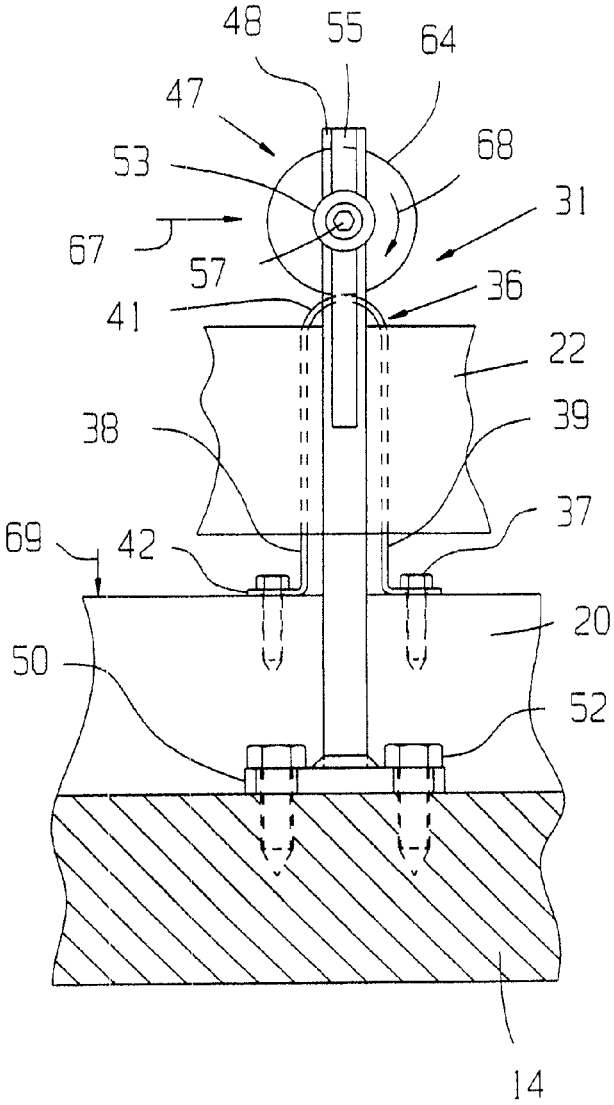
FIG. 4 is a sectional view taken along the line 4-4 of FIG. 2.
Figure 5:
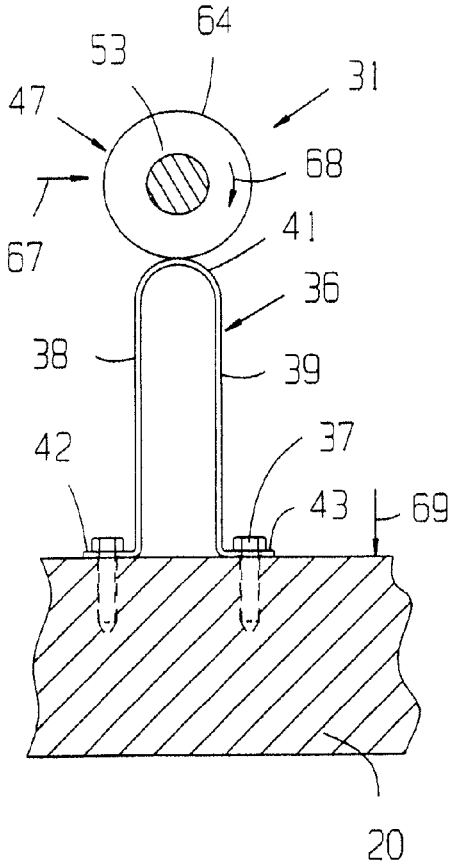
FIG. 5 is a sectional view taken along the line 5-5 of FIG. 2.

In use, as shown in FIG. 1, sealing mechanisms 29 and 32 are secured to door jambs 14 and 16 and opposite ends of door panel 17. Sealing mechanisms 30 and 33 are secured to door jambs 14 and 16 and opposite ends of door panel 18. Sealing mechanisms 31 and 34 are secured to door jambs 14 and 16 and opposite ends of door panel 20. The locations of the sealing mechanisms on the door jambs and door panels can vary to provide an effective surface sealing engagements of the door panels with adjacent door jambs. When door 12 is moved down to the closed position, the brackets of door sealing mechanisms 30 and 31 move past roller holder 47 of door sealing mechanism 29. As shown in FIGS. 4 and 5, when roller holder 47 is moved in the direction of arrow 67, roller 64 rides on convex top section 41 of bracket 36 and rotates in a clockwise direction shown by arrow 68 until roller 64 rests on the middle portion of top section 41. Roller 64 applies a force, shown by arrows 69, on door panel 17 that retains door panel 17 to engage the inside surface 71 of door jamb 14 and seal 15. The surface 71 contact between door panel 17 and jamb 14 prevents air leakage and eliminates oscillations of door 12 and resultant noise. The roller holders associated with door sealing mechanisms 30 and 31 engage their respective shorter brackets concurrently with the engagement of roller holder 47 with bracket 36 when door 12 is in the closed position. The door sealing mechanisms 32 to 34 operate in the same manner as door sealing mechanisms 29 to 31 whereby opposite sides of door panels 17 to 20 are retained in surface sealing contact with jambs 14 and 16 and seal 15. When door 12 is moved upwardly from the closed position, the open position roller 64 rotates in a counterclockwise direction and out of engagement with the top section 41 of bracket 36. The door panels are released from surface sealing engagement with adjacent door jambs thereby allowing the door 12 to be moved along tracks 22 and 23 to the open position.

Alternative embodiments of the roll-up door sealing mechanisms are shown in FIGS. 8 to 19. Each of these door sealing mechanisms are used with a conventional roll-up garage door to retain the door when in its closed position in a surface sealing engagement with adjacent doorway jambs. The surface sealing engagement of the door with the jambs eliminates the air space around the door thereby inhibiting cold air, water, dust and snow from flowing into the interior of the garage. Also, warm air in the garage does not escape past the door into the outside atmosphere. The door sealing mechanisms further prevent lateral movement or oscillations of the door relative to the door jambs that produce objectionable noise and vibrations.

Figure 8:
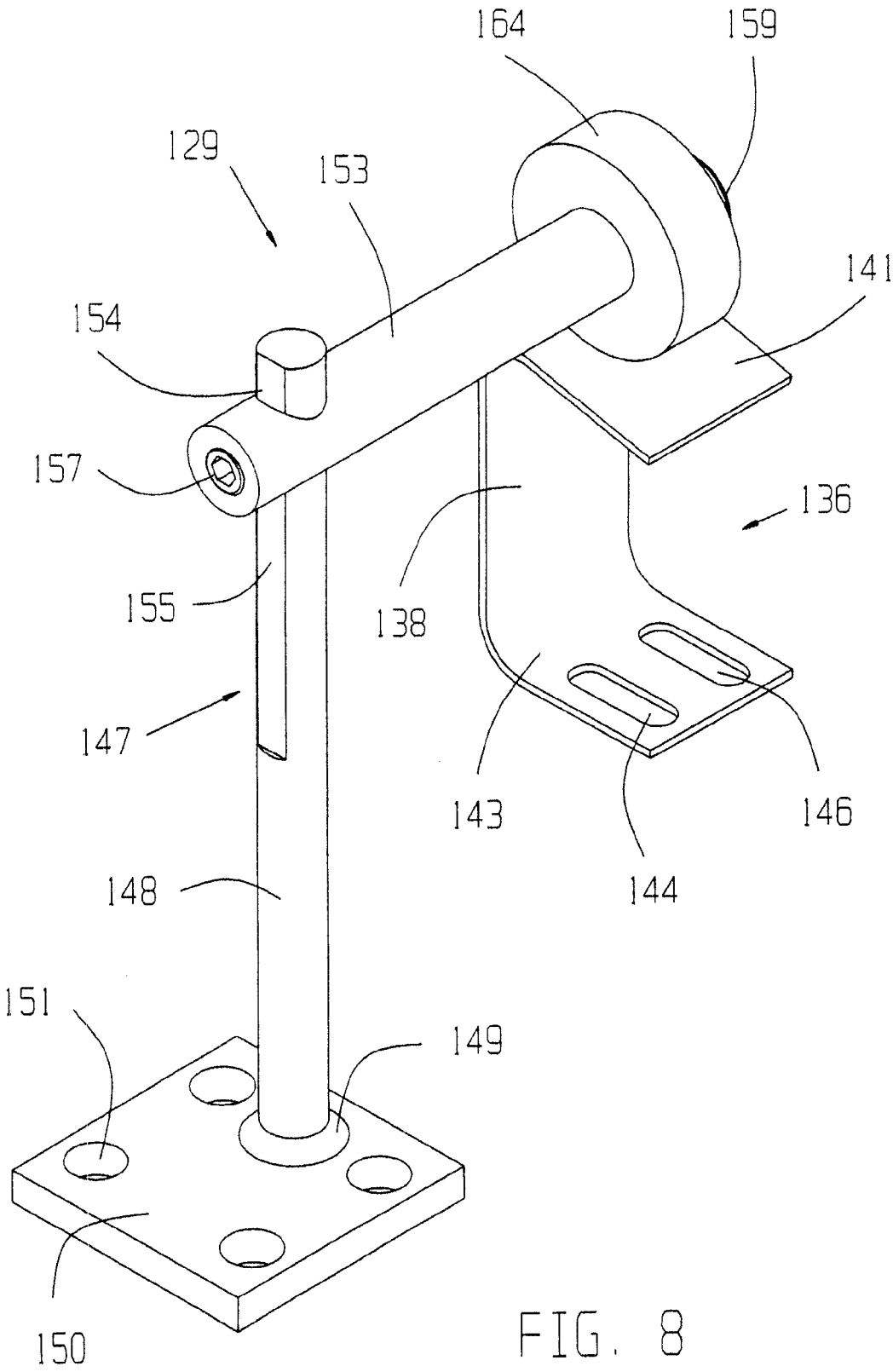
FIG. 8 is a perspective view of a second embodiment of a door sealing mechanism for holding a roll-up door closed against a door jamb.
Figure 9:
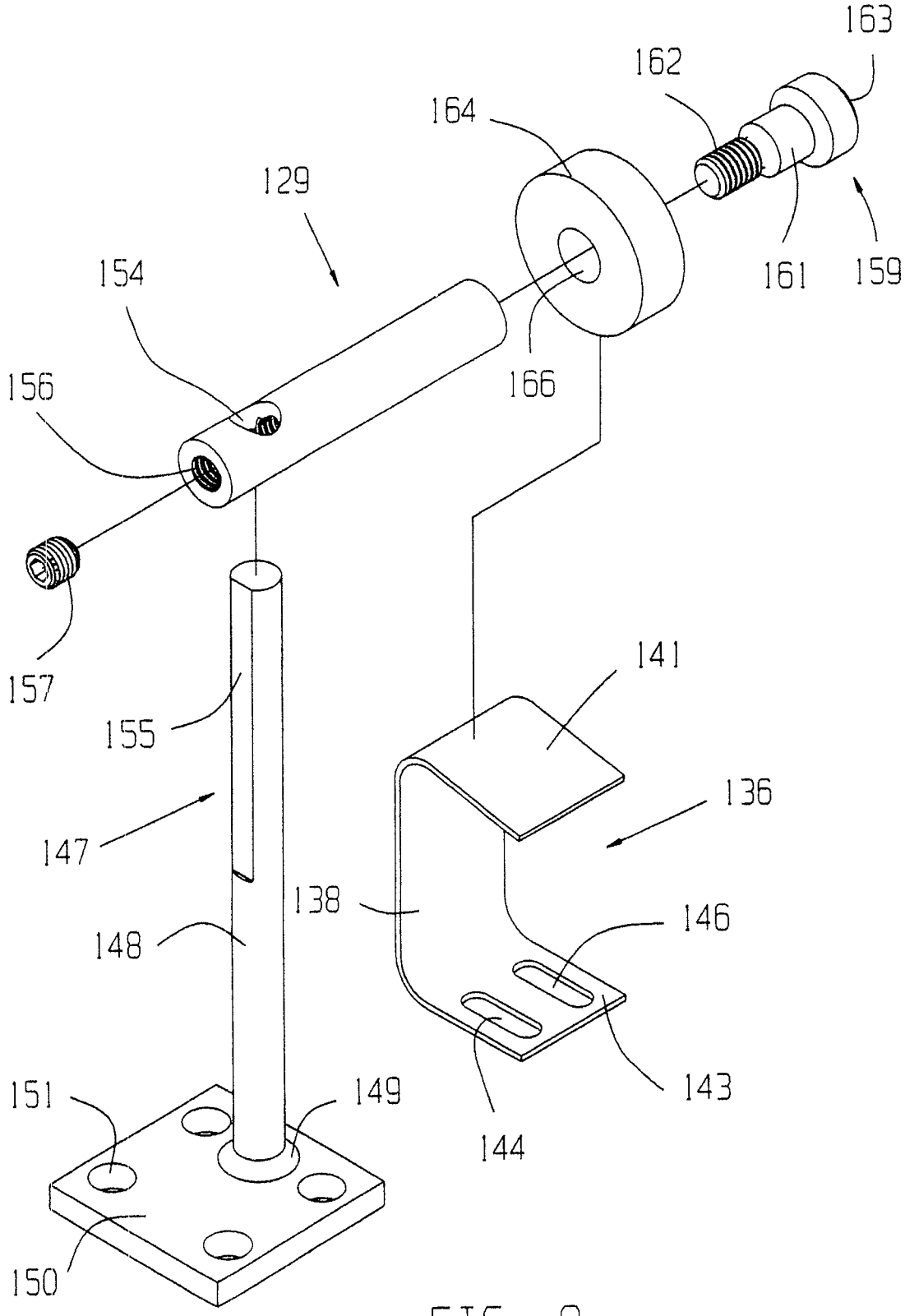
FIG. 9 is an exposed perspective view of the door sealing mechanism of FIG. 8.

A second embodiment of the door sealing mechanism 129, shown in FIGS. 8 and 9, has a first member or bracket 136 adapted to be fastened to a panel of roll-up door. Bracket 136 is a one-piece metal member having an upright section or back 138 joined to an inclined top section 141. Top section 141 is an inclined generally flat platform located above a base 143 joined to the bottom of back 138. Base 143 has two elongated openings 144 and 146 for fasteners, such as screws, that attach bracket 136 to a door panel. Openings 144 and 146 allow the location of bracket 136 to be adjusted on the roll-up door.

A second member comprising a roller holder 147 cooperates with bracket 136 to retain a roll-up door when in the closed position in surface sealing engagement with adjacent door jambs. Roller holder 147 has a linear post 148 secure with a weld 149 to a flat base 150. Holes 151 in base 150 accommodate fasteners, such as screws, that secure holder 147 to a door jamb located laterally of bracket 136. An arm 153 has a transverse hole 154 open to an axial threaded hole 156. The outer end section of post 148 has a flat section 155 located in hole 154. Set screw 157 threaded into the end of arm 153 engages flat section 155 of post 148 to prevent rotation of arm 153 on post 148. The post 148 extended through hole 154 is secured to post 148 with set screw 157 threaded into hole 156 and engageable with flat section 155 of post 148. The location of arm 153 on post 148 is adjustable along the length of post 148 by releasing set screw 157 from post 148 to allow arm 152 to be moved relative to post 148. Set screw 157 is turned tight against post 148 to retain arm 153 in its adjusted position. The outer end of arm 153 has an axial threaded hole accommodating a bolt 159 rotatably supporting a roller 164. Bolt 159 has a cylindrical shoulder 161, a thread end 162 and a head 163. Roller 164 has a central cylindrical bore 166 that rides on cylindrical stem 161 whereby roller 164 is free to rotate on shoulder 161 of bolt 159. In use, when the door is moved to the closed position, the inclined platform 141 of bracket 136 contacts roller 164 and moves door into surface sealing engagement with adjacent door jambs. The roller 164 applies a sealing force to the door which is substantially normal to the plane of the door to reduce vertical forces on the door.

Figure 10:
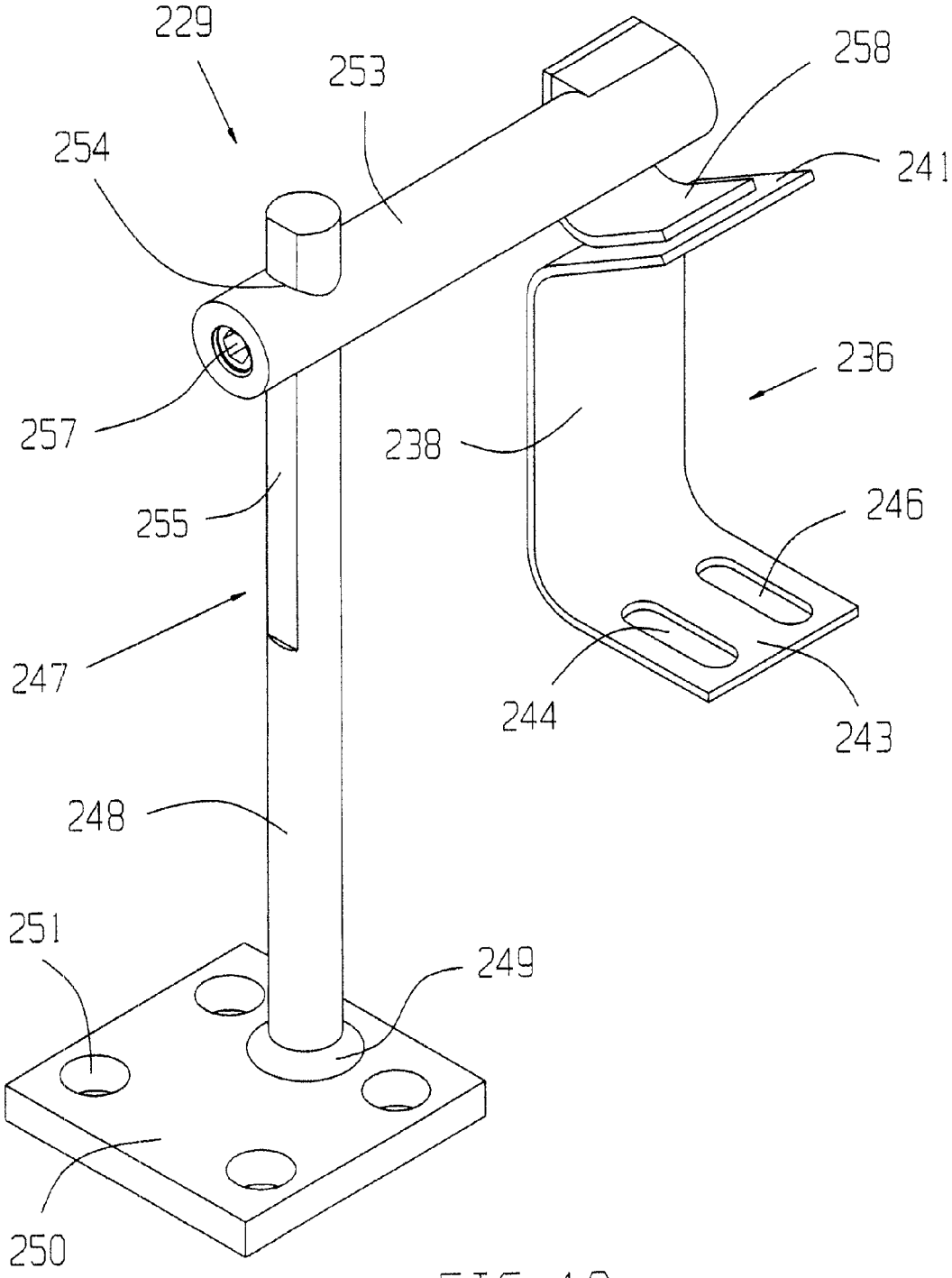
FIG. 10 is a perspective view of a third embodiment of a door sealing mechanism for holding a roll-up door closed against a door jamb.
Figure 11:
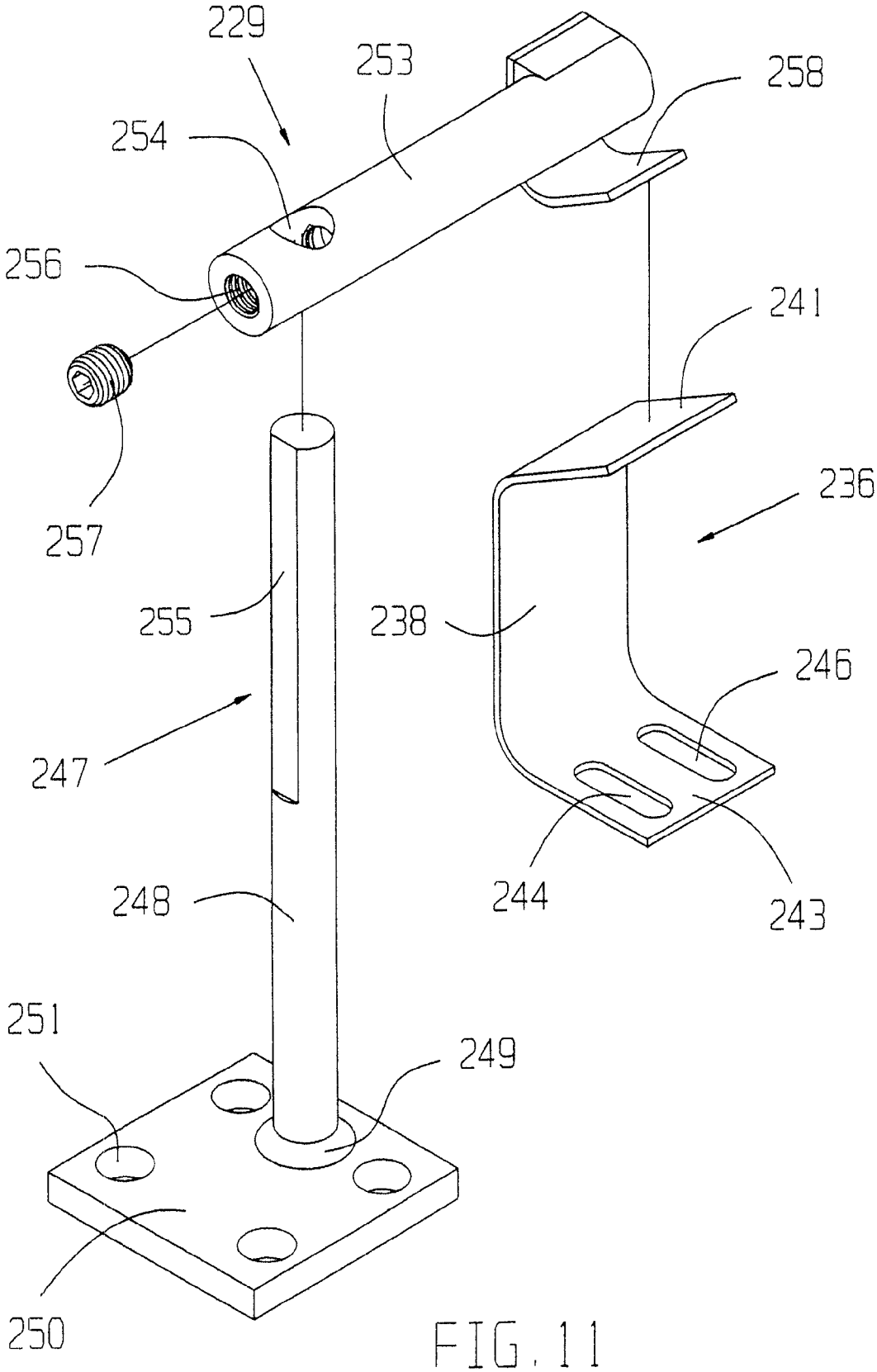
FIG. 11 is an exploded perspective view of the door sealing mechanism of FIG. 10.

A third embodiment of the door sealing mechanism 229, shown in FIGS. 10 and 11, comprises a first member or bracket 236 cooperating with a second member or holder 247 to retain a roll-up door in surface sealing engagement with adjacent door jambs. Bracket 236 is a one-piece metal member having an upright section or back 238 joined to an upwardly inclined top section 241 and a base 243. Holes 244 and 246 in base 243 accommodate fasteners, such as screws, that secure bracket 236 to a panel of the door.

The second member is a holder 247 comprising of a linear post 248 secured with a weld 249 to a flat base 250. Holes 251 in base 250 accommodate fasteners, such as screws, that secure holder 247 to a door jamb adjacent bracket 236. An arm 253 has a transverse hole 254 accommodating the outer end section of post 248. Arm 253 has an axial threaded hole 256 for a set screw 257 adapted to be turned tight against the flat section 255 of post 248 thereby fixing the location of arm 253 on post 248 and preventing rotation of arm 253 or post 248. A curved lip or flange 258 secured to the outer end of arm 253 engages top section 241 of bracket 236 when the door is in the closed position to retain the door in surface sealing engagement with adjacent door jambs.

Figure 12:
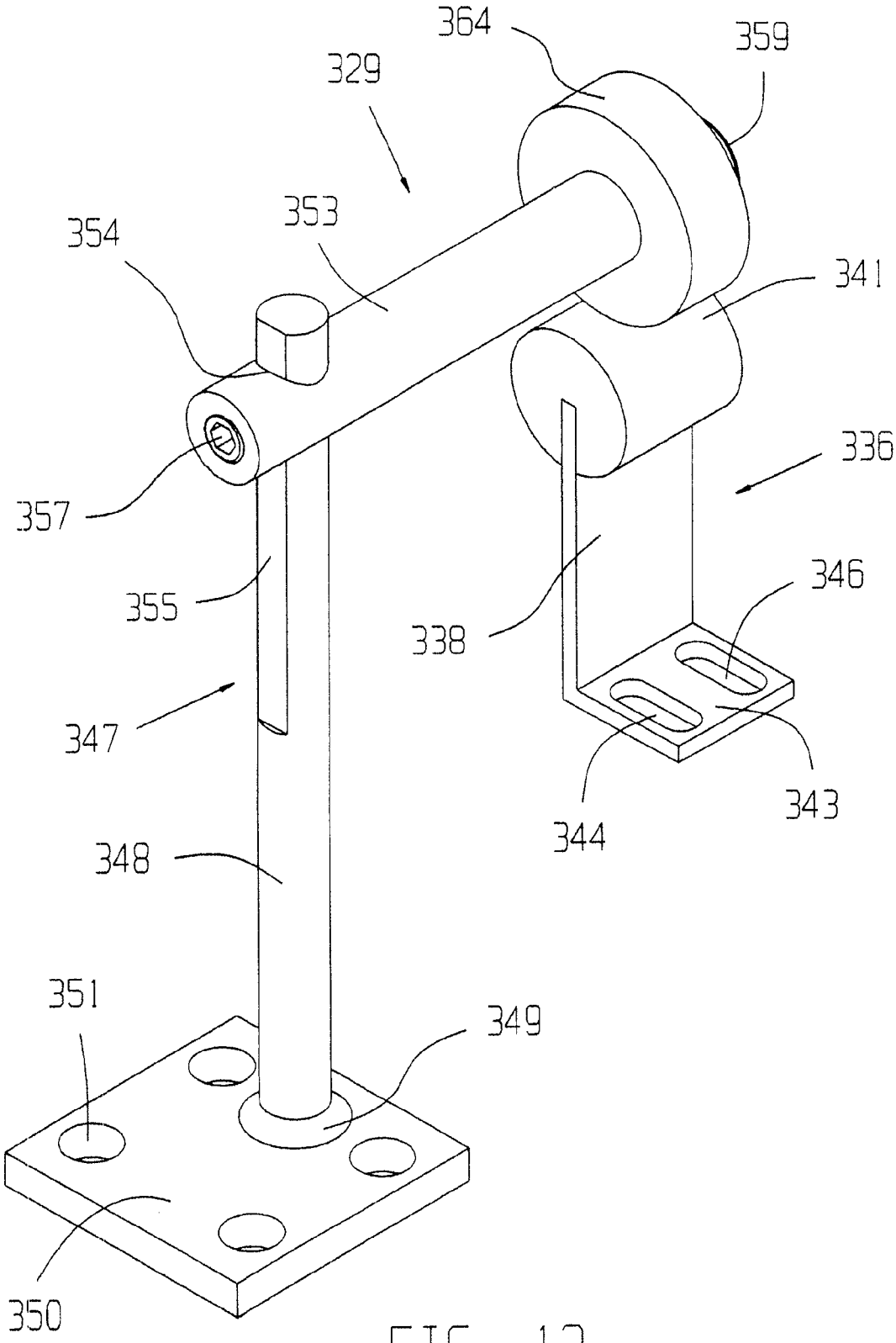
FIG. 12 is a perspective view of a fourth embodiment of a door closing mechanism for holding a roll-up door closed against a door jamb.
Figure 13:
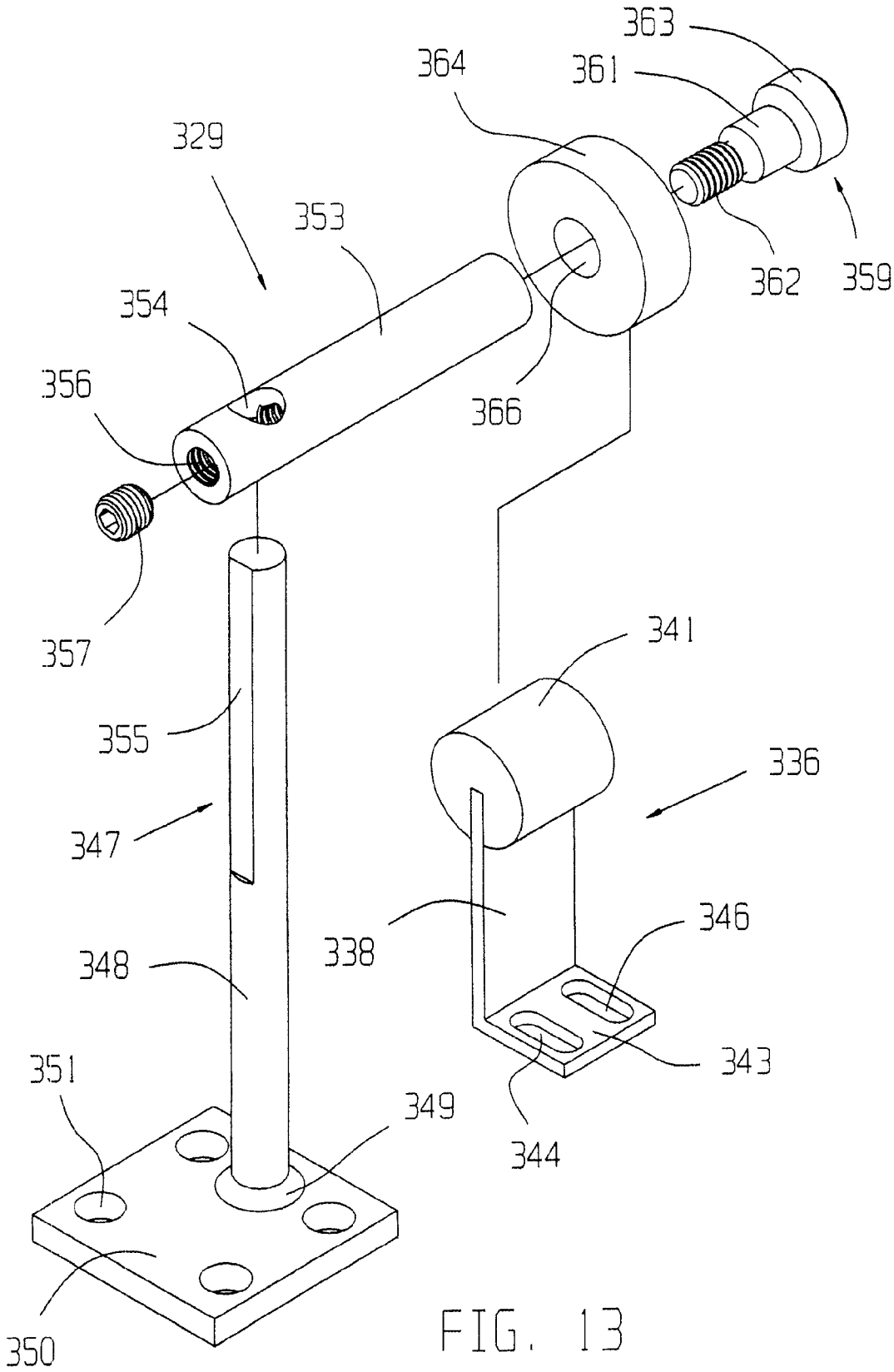
FIG. 13 is an exploded perspective view of the door sealing mechanism of FIG. 12.

A fourth embodiment of the door sealing mechanism 329, shown in FIGS. 12 and 13, comprises a first member or bracket 336 cooperating with a second member or roller holder 347 to retain a roll-up door in surface sealing engagement with adjacent door jambs. Bracket 336 has an upright section or back 338 secured to a cylindrical knob 341 having an outer cylindrical surface. A base 343 with elongated openings 344 and 346 is secured to the bottom of back 338. Elongated openings 344 and 346 accommodate fasteners, such as screws, that attach bracket 336 to a panel on a roll-up door.

The second member comprises a roller holder 347 mounted on a door jamb adjacent bracket 336 cooperating with bracket 336 when the door is in the closed position to retain the door in surface sealing engagement with the adjacent door jamb. Roller holder 347 has the same structure and functions as roller holder 47 shown in FIGS. 6 and 7 incorporated herein by reference with corresponding posts having the prefix 3. Post 348 attached to base 350 supports a lateral arm 353. Set screw 357 secures arm 353 in a selected position on post 348 to locate roller 364 in contact with cylindrical knob 341 when the door is in the closed position to retain the door in surface sealing engagement with the adjacent door jamb.

Figure 14:
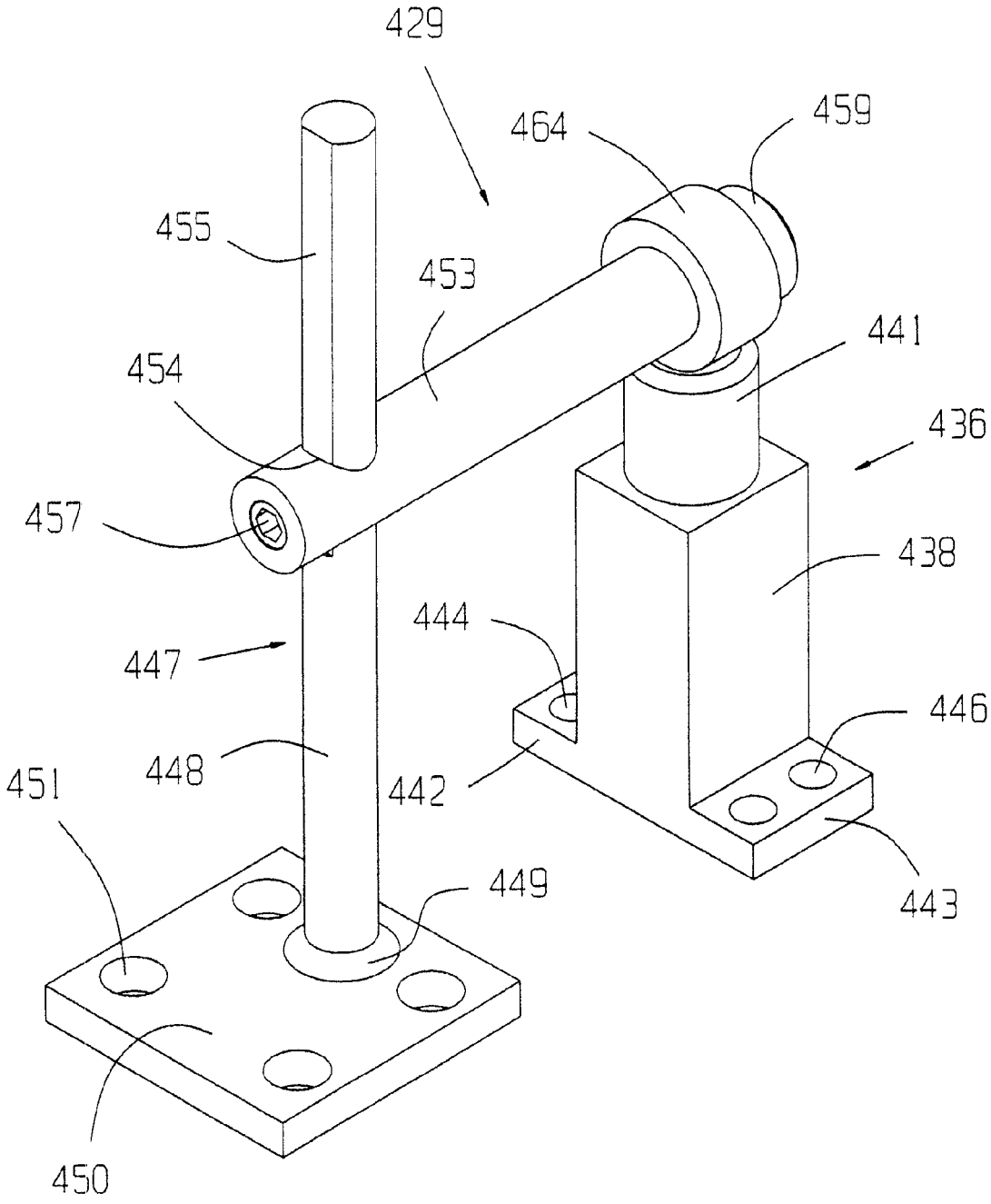
FIG. 14 is a perspective view of a fifth embodiment of a door sealing mechanism for holding a roll-up door closed against a door jamb.
Figure 15:
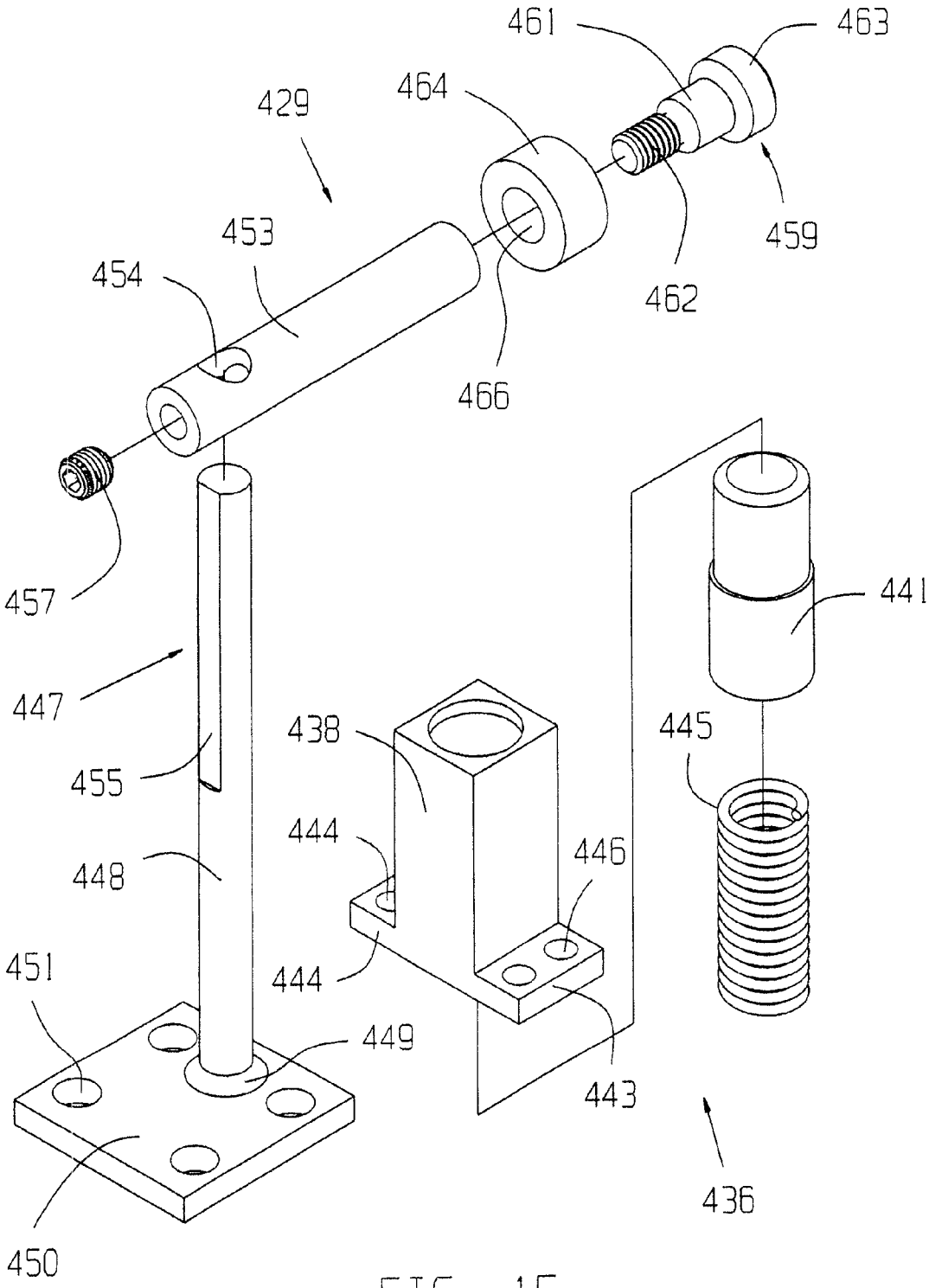
FIG. 15 is an exploded perspective view of the door sealing mechanism of FIG. 14.

A fifth embodiment of the door sealing mechanism 429, shown in FIGS. 14 and 15, comprises a first member 436 cooperating with a second member or roller holder 447 to retain a roll-up door in surface sealing engagement with the adjacent door jambs. First member 336 has a housing 438 with bottom flanges 442 and 443. Holes 444 and 446 in flanges 442 and 443 accommodate fasteners, such as screws, that attaches housing 438 to a panel of a roll-up door. Housing 438 has an interior chamber partly accommodating a cylindrical member 441 and a coil spring 445 as shown in FIG. 15. The upper end of member 441 engages roller 464 of roller holder 447. Spring 445 exerts a biasing force on member 441 to keep the top surface of member 441 engaged with roller 464 and retain roll-up door in surface sealing engagement with the adjacent door jamb.

Figure 6:
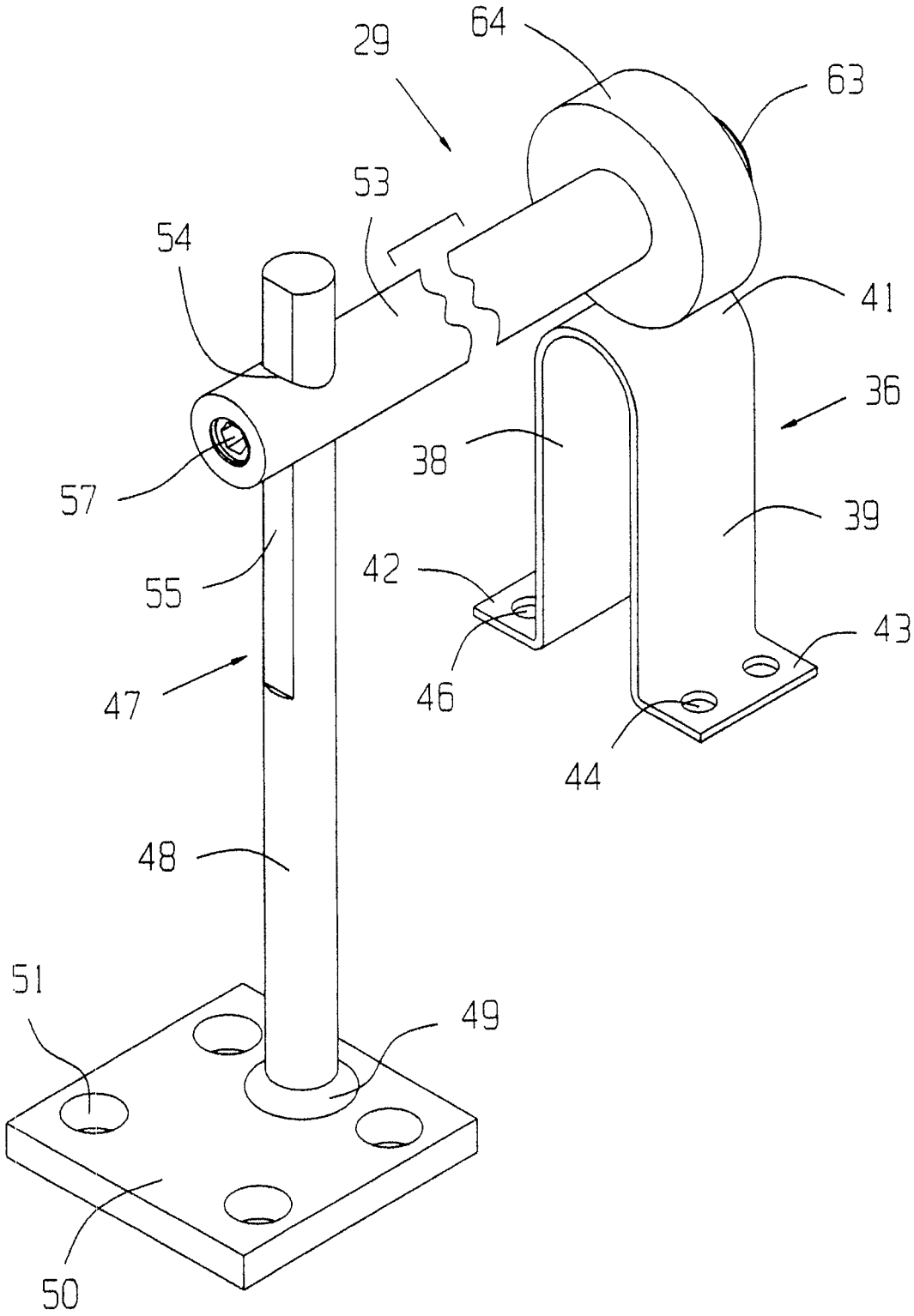
FIG. 6 is a foreshortened perspective view of the door sealing mechanism of FIG. 2.

Roller holder 447 has the same structure and fasteners as roller holder 47 shown in FIGS. 6 and 7 incorporated herein by reference with corresponding parts having the prefix 4. Set screw 457 secures arm 453 to post 448 in a selected position on post 448 to locate roller 464 in contact with member 441 when the door is in the closed position to retain the door in surface sealing engagement with the adjacent door jamb.

Figure 16:
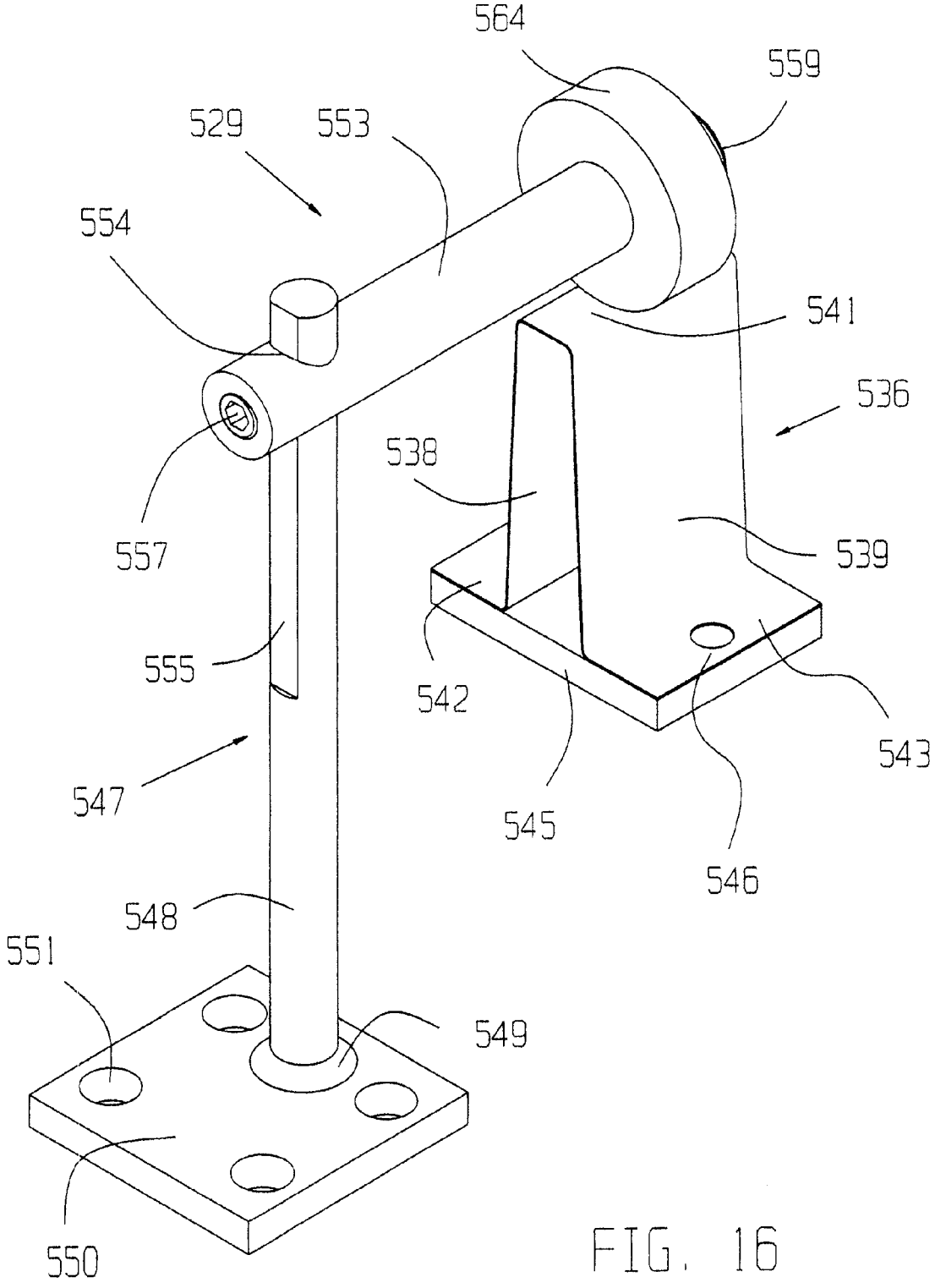
FIG. 16 is a perspective view of a sixth embodiment of a door closing mechanism for holding a roll-up door closed against a door jamb.
Figure 17:
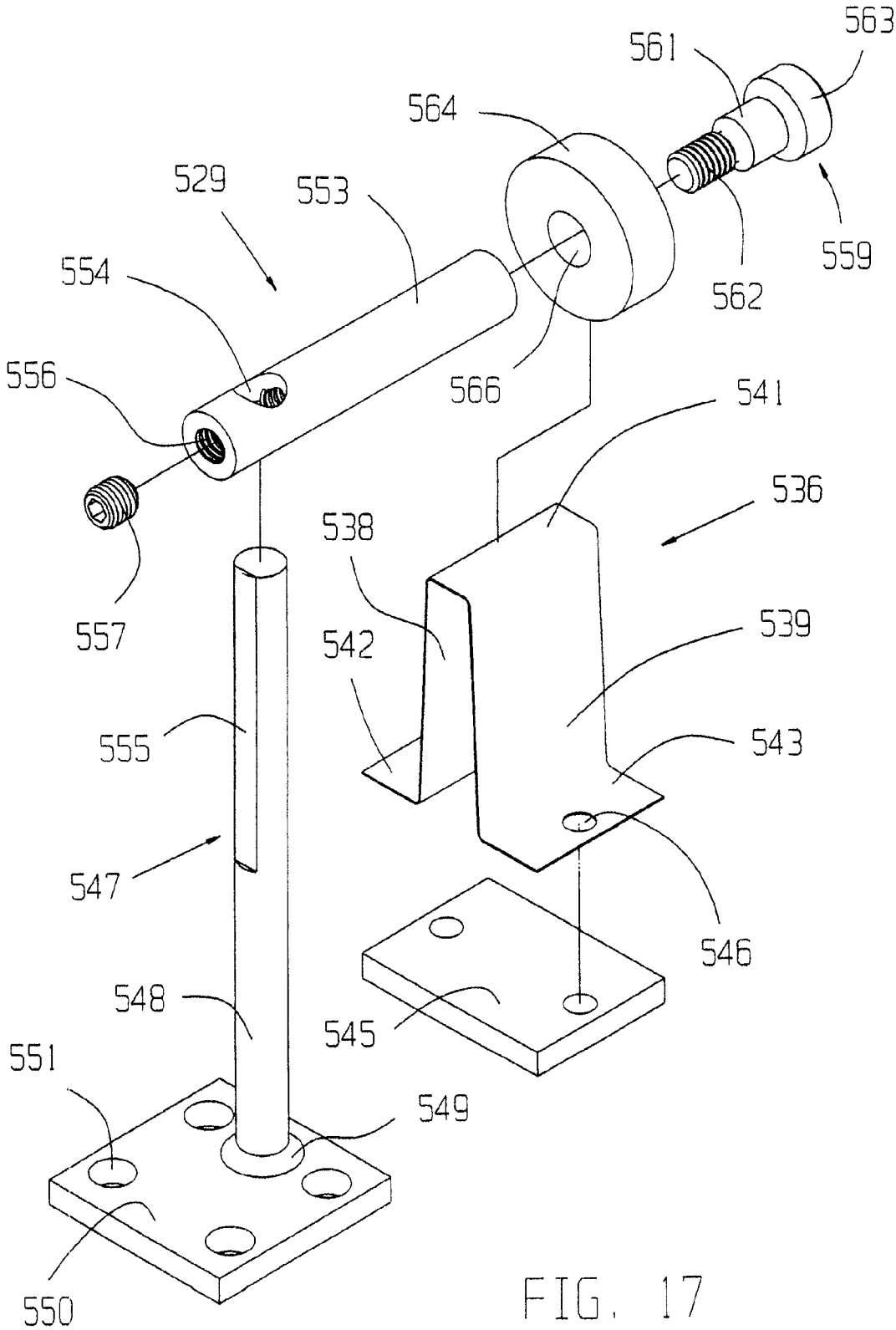
FIG. 17 is an exploded perspective view of the door sealing mechanism of FIG. 16.

A sixth embodiment of the door sealing mechanism 529, shown in FIGS. 16 and 17, comprises a first member or bracket 536 cooperating with a second member or roller holder 547 to retain a roll-up door in surface sealing engagement with the adjacent door jamb. First member 536 is an inverted U-shaped bracket having side sections 538 and 539 joined to a top wall 541 and bottom flanges 542 and 543. The bracket 536 is supported on a spacer block or shim 545. Flanges 542 and 543 and block 545 have aligned holes 546 for fasteners, such as screws, adapted to attach the bracket and block 545 to a panel of the roll-up door. One or more blocks can be used with the bracket to change the effective height of the top wall 541 of the bracket 536. The bracket can be attached directly to the panel of the roll-up door.

Roller holder 547 has the same structure and functions as roller holder 47 shown in FIGS. 6 and 7, incorporated herein by reference, with corresponding posts having the prefix 5. Set screw 557 secures arm 553 to post 548 in a selected position on post 548 to locate roller 564 in contact with top wall 541 of the bracket when the roll-up door is in the closed position. The roller holder 547 with the roller 564 on top wall 541 of the bracket applies a sealing force on the roll-up door to retain the roll-up door in surface sealing engagement with the adjacent door jamb. The sealing force on the roll-up door is substantially normal to the plane of the closed roll-up door.

Figure 18:
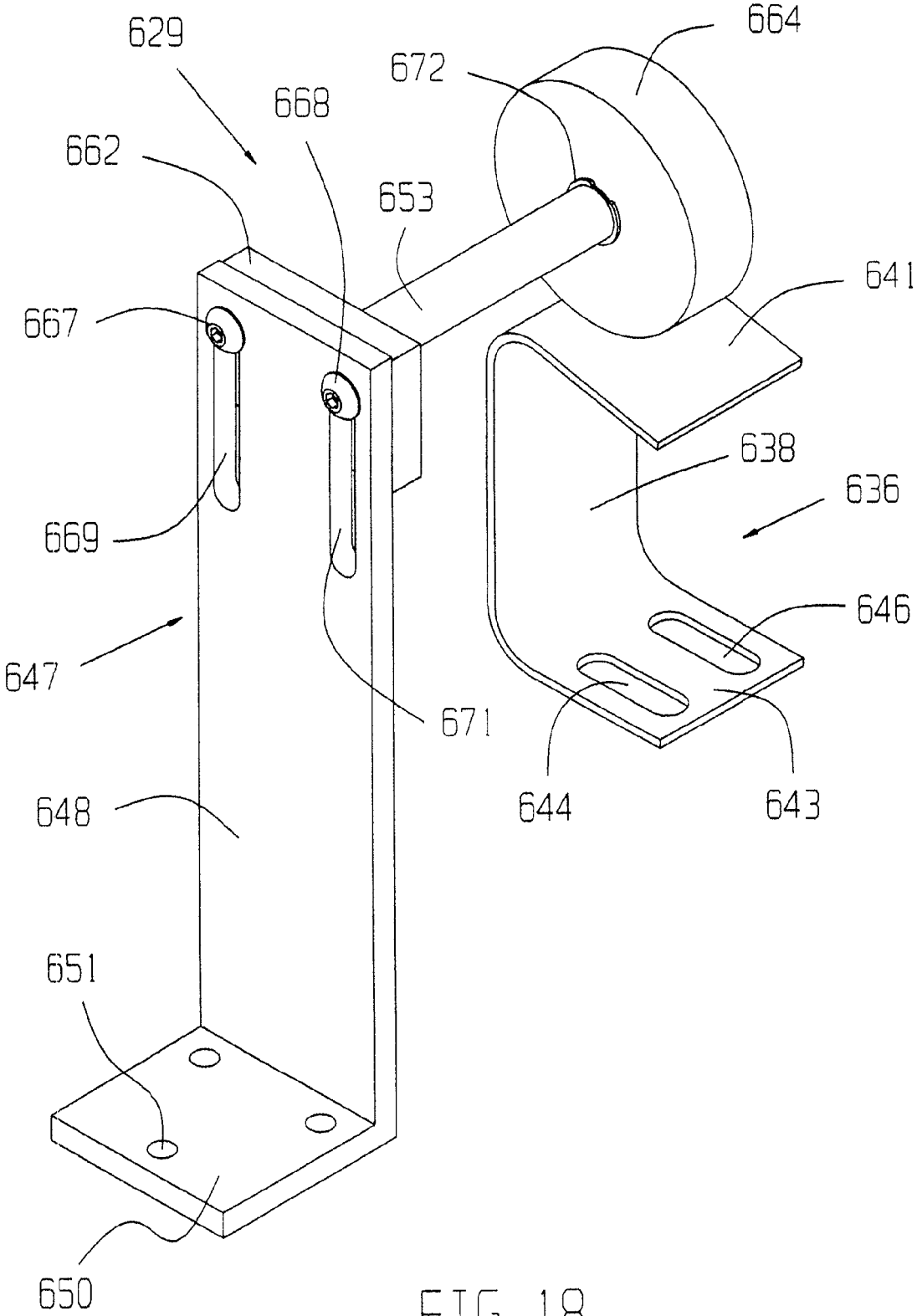
FIG. 18 is a perspective view of a seventh embodiment of a door closing mechanism for holding a roll-up door closed against a door jamb.
Figure 19:
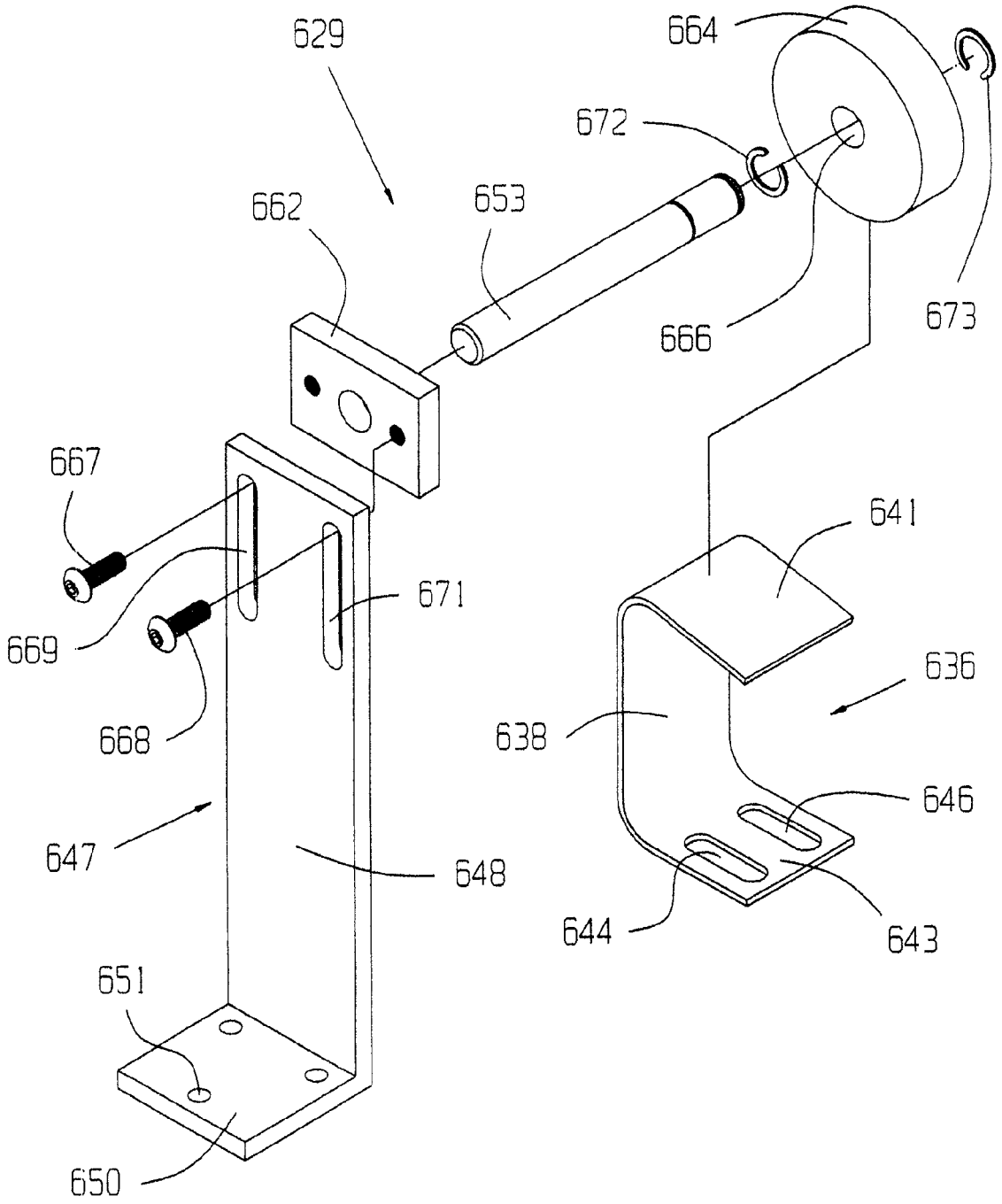
FIG. 19 is an exploded perspective view of the door sealing mechanism of FIG. 18.

A seventh embodiment of the door sealing mechanism 629, shown in FIGS. 18 and 19, comprises a first member or bracket 636 cooperating with a second member or roller holder 647 to retain a roll-up door in surface sealing engagement with the adjacent door jambs. Bracket 636 is a one-piece metal member having an upright section or back 638 joined to an inclined top section 641. Top section 641 is an inclined generally flat platform located above a base 643 joined to the bottom of back 638. Base 643 has a pair of elongated openings 644 and 646 for fasteners, such as screws, that attach bracket 636 to a panel of the roll-up door. Openings 644 and 646 allow the location of bracket 636 to be adjusted on the roll-up door.

The roller holder 647 has a flat upright post 648 joined to a base 650 having holes 651 for fasteners, such as screws, that attach roller holder 647 to a door jamb adjacent bracket 636. A lateral arm 653 is secured to a block 662 attached with bolts 667 and 668 to post 648. Post 648 has a pair of elongated uprights slots 669 and 671 for bolts 667 and 668 whereby the position of arm 653 relative to post 648 can be adjusted. A roller 664 has a center bore 666 accommodating the outer end of arm 653 whereby roller 664 is rotatably mounted on arm 653. Split washers 672 and 673 mounted on arm 653 retain roller 664 on arm 653. As shown in FIG. 18, roller 664 contacts top section 641 of bracket 636 when roll-up door is in the closed position to retain the roll-up door in surface sealing engagement with adjacent door jamb.

Several embodiments have been shown in the drawing and described of the door sealing mechanisms for retaining a door, including a roll-up door, in surface sealing engagement with adjacent door jambs. Changes and modifications of the brackets and roller holders may be made by persons skilled in the art without departing from the inventory as defined by the following claims.

The invention claimed is:

1. A sealing mechanism for a roll-up door having an inside surface and an outside surface engageable with a door jamb having an inside edge when the roll-up door is a closed position comprising:

a bracket adapted to be attached to the inside surface of the roll-up door, said bracket having a first section spaced away from the inside surface of the roll-up door, a post adapted to be attached to the inside of a door jamb adjacent the bracket, an arm mounted on the post extended from the post to a location adjacent the first section of the bracket, wherein the arm has a hole and said post includes a portion extended through the hole in the arm and a fastener is mounted on the arm engageable with the portion of the post to hold the arm in position, a roller rotatably mounted on the arm engageable with the first section of the bracket when the roll-up door is in the closed position to retain hold the outside surface of the roll-up door in surface sealing engagement with the inside surface of the door jamb.

2. The sealing mechanism of claim 1 including;

a base secured to the post, said base having holes for fasteners for attaching the base to the inside surface of the door jamb.

3. The sealing mechanism of claim 1 wherein:

the bracket is an inverted U-shaped bracket having a top wall comprising said first section of the bracket engageable with said roller when the roll-up door is in the closed position.

4. The sealing mechanism of claim 1 wherein:

the bracket includes a cylindrical member having said first section engageable with said roller when the roll-up door is in the closed position.

5. The sealing mechanism of claim 1 wherein:

the portion of the post has a flat surface extended through the hole in the arm, and said fastener being engageable with the flat surface of the post to inhibit rotation of the arm relative to the post.

6. The sealing mechanism of claim 1 wherein:

the bracket comprises a housing adapted to be attached to the inside surface of the roll-up door, a body mounted on the housing, a movable member mounted on the body, said movable member having a portion thereof engageable with the roller, and a biasing member engageable with the movable member to bias the movable member in engagement with the roller when the door is in the closed position to retain the inside surface of the roll-up door in surface sealing engagement with the inside surface of the door jamb.

7. The sealing mechanism of claim 1 wherein:

the roll-up door has panels connected with hinges, a track attached to the door iambs and rotatable members mounted on the roll-up door panels engageable with the track to guide the door along the track between open and closed positions relative to a doorway, said bracket adapted to be attached to the inside surface of the roll-up door adjacent said track, said post adapted to be attached to the inside surface of the door jamb adjacent said track, and said arm extended from said post to said bracket over said track.

8. A sealing mechanism for a roll-up door having an inside surface and an outside surface engageable with an inside surface of door jambs when the roll-up door is in a closed position comprising:

a bracket having a top wall, first fasteners for attaching the bracket to the inside surface of the roll-up door, a post extended laterally away from a door jamb adjacent the bracket, a base connected to the post, second fasteners for attaching the base to the inside surface of the door jamb, an arm mounted on the post extended from the post to a location adjacent the top wall of the bracket, wherein the arm has a hole and said post includes a portion extended through the hole in the arm and a third fastener is mounted on the arm engageable with the portion of the post to hold the arm in position, a roller rotatably mounted on the arm engageable with the top wall of the bracket when the roll-up door is in the closed position to retain the outside surface of the roll-up door in surface sealing engagement with the inside surface of the door jamb.

9. The sealing mechanism of claim 8 wherein:

the bracket is an inverted U-shaped member having said top wall engageable with said roller.

10. The sealing mechanism of claim 8 wherein:

the bracket includes a cylindrical member having the top wall engageable with said roller.

11. The sealing mechanism of claim 8 wherein:

the portion of the post has a flat surface extended through the hole in the arm, and said third fastener being engageable with the flat surface of the post to inhibit rotation of the arm relative to the post.

12. A sealing mechanism for a roll-up door movably mounted on tracks, said roll-up door having an inside surface engageable with a door jamb having an inside surface when the roll-up door is in a closed position comprising:

a U-shaped bracket having a top wall adapted to be attached to the inside surface of the roll-up door, a post extended away from the inside wall of the door jamb adapted to be attached to the inside surface of the door jamb adjacent the bracket and spaced from a track, an arm mounted on the post extended from the post over the track to a location adjacent the top wall of the bracket, said arm having a hole, said post having a portion extended through the hole in the arm, a fastener retained on the arm engageable with the portion of the post to hold the arm in a selected location on the post, and a roller rotatably mounted on the arm engageable with the top wall of the bracket when the roll-up door is in the closed position to hold the inside surface of the roll-up door in surface sealing engagement with the inside surface of the door jamb.

13. The sealing mechanism of claim 12 wherein:

the portion of the post has a flat surface extended through the hole in the arm, and said fastener being engageable with the flat surface of the post to inhibit rotation of the arm relative to the post and allow adjustment of the arm along the length of the post.

14. The sealing mechanism of claim 12 wherein:

the arm has an end portion adjacent said hole and a threaded opening in said end portion open to said hole, said fastener comprising a threaded member located in the threaded opening in the arm and engageable with the post to hold the arm in a selected position on the post and retain the roller on the top wall of the bracket when the roll-up door is in the closed position.

* * * * *